US006330531B1

(12) United States Patent
Su

(10) Patent No.: US 6,330,531 B1
(45) **Date of Patent: *Dec. 11, 2001**

(54) COMB CODEBOOK STRUCTURE

(75) Inventor: Huan-Yu Su, San Clemente, CA (US)

(73) Assignee: Conexant Systems, Inc., Newport Beach, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/156,649

(22) Filed: Sep. 18, 1998

Related U.S. Application Data

(60) Provisional application No. 60/097,569, filed on Aug. 24, 1998.

(51) Int. Cl.[7] ..... G10L 19/12
(52) U.S. Cl. ..... 704/204; 704/221
(58) Field of Search ..... 704/201, 203, 704/204, 219, 220, 221, 223

(56) References Cited

U.S. PATENT DOCUMENTS 5,451,951 * 9/1995 Elliott et al. ..... 704/220
5,621,852 * 4/1997 Lin ..... 704/219

FOREIGN PATENT DOCUMENTS 196 47 298 5/1997 (DE) .
WO92/06470 4/1992 (WO) .
WO96/35208 11/1996 (WO) .

OTHER PUBLICATIONS

Moulsley and Elliott, "Fast VQ–CELP—a speech coder for mobile radio," Sixth International Conference on Mobile Radio and Personal Communications, 1991, pp. 280 to 285.*

K. Mano, et al., "Design of a Pitch Synchronous Innovation CELP Coder for Mobile Communications," *IEEE Journal of Selected Areas on Communications*, vol. 13, No. 1, Jan. 1995, pp. 31–41.

Chang–Qian Chen, Soo–Ngee Koh, and Pratab Sivaprakasapillai, "A Novel Scheme for Optimising Partitioned VQ Using a Modified Resolution Measure", *Signal Processing*, vol. 56, No. 2, 1997, pp. 157–163.

Akitsoshi Kataoka, Sachiko Hosaka, Jotaro Ikedo, Takehiro Moriya, and Shinji Hayashi, "Improved CS–Celp Speech Coding in a Noisy Environment Using a Trained Sparse Conjugate Codebook", *Proceedings of the 1995 International Conference on Acoustics, Speech and Signal Processing*, vol. 1, 9–12, 1995, pp. 29–32.

(List continued on next page.)

*Primary Examiner*—William Korzuch
*Assistant Examiner*—Martin Lerner
(74) *Attorney, Agent, or Firm*—Farjami & Farjami LLP

(57) ABSTRACT

A speech encoding comb codebook structure for providing good quality reproduced low bit-rate speech signals in a speech encoding system. The codebook structure requires minimal training, if any, and allows for reduced complexity and memory requirements. The codebook includes a first and at least one additional sub-codebooks, each having a plurality of code-vectors. The codebook may be randomly populated. All even elements may be set to zero in a first codebook, and all odd elements may be set to zero on a second codebook. The resulting comb codebook includes code-vector combination of the code-vectors from the sub-codebooks. In certain embodiments, the code-vectors of the sub-codebooks may contain zero valued elements. In other embodiments where the code-vectors of the sub-codebooks contain only non-zero elements, zero valued elements may be inserted in between the non-zero elements of the sub-codebooks during the forming of the resultant comb codebook. In such an embodiment, the memory requirements would be further reduced in that the zero valued elements need not be stored.

16 Claims, 5 Drawing Sheets

OTHER PUBLICATIONS

W. Bastiaan Kleijn and Peter Kroon, "The RCELP Speech–Coding Algorithm," vol. 5, No. 5, Sep.–Oct. 1994, pp. 39/573–47/581.

C. Laflamme, J–P. Adoul, H.Y. Su, and S. Morissette, "On Reducing Computational Complexity of Codebook Search in CELP Coder Through the Use of Algebraic Codes," 1990, pp. 177–180.

Chih–Chung Kuo, Fu–Rong Jean, and Hsiao–Chuan Wang, "Speech Classification Embedded in Adaptive Codebook Search for Low Bit–Rate CELP Coding," IEEE Transactions on Speech and Audio Processing, vol. 3, No. 1, Jan. 1995, pp. 1–5.

Erdal Paksoy, Alan McCree, and Vish Viswanathan, "A Variable–Rate Multimodal Speech Coder with Gain–Matched Analysis–By–Synthesis," 1997, pp. 751–754.

Gerhard Schroeder, "International Telecommunication Union Telecommunications Standardization Sector," Jun. 1995, pp. i–iv, 1–42.

"Digital Cellular Telecommunications System; Comfort Noise Apsects for Enhanced Full Rate (EFR) Speech Traffic Channels (GSM 06.62)," May 1996, pp. 1–16.

W. B. Kleijn and K.K. Paliwal (Editors), Speech Coding and Synthesis, Elsevier Science B.V.; Kroon and W.B. Kleijn (Authors), Chapter 3: "Linear–Prediction Based on Analysis–by–Synthesis Coding", 1995, pp. 81–113.

W. B. Kleijn and K.K. Paliwal (Editors), Speech Coding and Synthesis, Elsevier Science B.V.; A. Das, E. Paskoy and A. Gersho (Authors), Chapter 7: "Multimode and Variable–Rate Coding of Speech," 1995, pp. 257–288.

B.S. Atal, V. Cuperman, and A. Gersho (Editors), Speech and Audio Coding for Wireless and Network Applications, Kluwer Academic Publishers; T. Taniguchi, Y. Tanaka and Y. Ohta (Authors), Chapter 27: "Structured Stochastic Codebook and Codebook Adaptation for CELP," 1993, pp. 217–224.

B.S. Atal, V. Cuperman, and A. Gersho (Editors), Advances in Speech Coding, Kluwer Academic Publishers; I. A. Gerson and M.A. Jasiuk (Authors), Chapter 7: "Vector Sum Excited Linear Prediction (VSELP)," 1991, pp. 69–79.

B.S. Atal, V. Cuperman, and A. Gersho (Editors), Advances in Speech Coding, Kluwer Academic Publishers; J.P. Campbell, Jr., T.E. Tremain, and V.C. Welch (Authors), Chapter 12: "The DOD 4.8 KBPS Standard (Proposed Federal Standard 1016)," 1991, pp. 121–133.

B.S. Atal, V. Cuperman, and A Gersho (Editors), Advances in Speech Coding, Kluwer Academic Publishers; R.A. Salami (Author), Chapter 14: "Binary Pulse Excitation: A Novel Approach to Low Complexity CELP Coding," 1991, pp. 145–157.

* cited by examiner

COMB CODEBOOK STRUCTURE

This application claims benefit of Prov. No. 60/097,569 filed Aug. 24, 1998.

BACKGROUND OF THE INVENTION

1. Technical Field

The present invention relates generally to speech encoding and decoding in mobile cellular communication networks and, more particularly, it relates to various techniques used with code-excited linear prediction coding to obtain high quality speech reproduction through a limited bit rate communication channel.

2. Related Art

Signal modeling and parameter estimation play significant roles in data compression, decompression, and coding. To model basic speech sounds, speech signals must be sampled as a discrete waveform to be digitally processed. In one type of signal coding technique, called linear predictive coding (LPC), the signal value at any particular time index is modeled as a linear function of previous values. A subsequent signal is thus linearly predictable according to an earlier value. As a result, efficient signal representations can be determined by estimating and applying certain prediction parameters to represent the signal.

For linear predictive analysis, neighboring speech samples are highly correlated. Coding efficiency can be improved by canceling redundancies by using a short term predictor to extract the formants of the signal. To compress speech data, it is desirable to extract only essential information to avoid transmitting redundancies. If desired, speech can be grouped into segments or short blocks, where various characteristics of the segments can be identified. "Good quality" speech may be characterized as speech that, when reproduced after having been encoded, is substantially perceptually indistinguishable from spoken speech. In order to generate good quality speech, a code excited linear predictive (CELP) speech coder must extract LPC parameters, pitch lag parameters (including lag and its associated coefficient), an optimal excitation (innovation) code-vector from a supplied codebook, and a corresponding gain parameter from the input speech. The encoder quantizes the LPC parameters by implementing appropriate coding schemes.

More particularly, the speech signal can be modeled as the output of a linear-prediction filter for the current speech coding segment, typically called frame (typical duration of about 10–40 ms), where the filter is represented by the equation:

$$A(z)=1-a_1z^{-1}-a_2z^{-2}-\ldots-a_{np}z^{-np}$$

and the $n^{th}$ sample can be predicted by $$\hat{y}(n)=\sum_{k=1}^{np} a_k * y(n-k)$$

where "np" is the LPC prediction order (usually approximately 10), y(n) is sampled speech data, and "n" represents the time index.

The LPC equations above describe the estimation of the current sample according to the linear combination of the past samples. The difference between them is called the LPC residual, there:

$$r(n)=y(n)-\hat{y}(n)=y(n)-\sum_{k=1}^{np}\alpha a_k(k)$$

A perceptual weighting W(z) filter based on the LPC filter that models the sensitivity of the human ear is then defined by:

$$W(z)=\frac{A(z/\gamma 1)}{A(z/\gamma 2)} \quad \text{where} \quad 0<\gamma_2<\gamma_1\leq 1$$

The LPC prediction coefficients $a_1, a_2, \ldots, a_p$ are quantized and used to predict the signal, where "p" represents the LPC order.

After removing the correlation between adjacent signals, the resulting signal is further filtered through a long term pitch predictor to extract the pitch information, and thus remove the correlation between adjacent pitch periods. The pitch data is quantized and used for predictive filtering of the speech signal. The information transmitted to the decoder includes the quantized filter parameters, gain terms, and the quantized LPC residual from the filters.

The LPC residual is modeled by samples from a stochastic codebook. Typically, the codebook comprises N excitation code-vectors, each vector having a length L. According to the analysis-by-synthesis procedure, a search of the codebook is performed to determine the best excitation code-vector which, when scaled by a gain factor and processed through the two filters (i.e., long and short term), most closely restores the pitch and voice information. The resultant signal is used to compute an optimal gain (the gain corresponding to the minimum distortion) for that particular excitation vector and an error value. This best excitation code-vector and its associated gain provide for the reproduction of "good speech" as described above. An index value associated with the code-vector, as well as the optimal gain, are then transmitted to the receiver end of the decoder. At that point, the selected excitation vector is multiplied by the appropriate gain, and the signal is passed through the two filters to generate the restored speech.

To extract desired pitch parameters, the pitch parameters that minimize the following weighted coding error energy "d" must be calculated for each coding subframe, where one coding frame may be divided into several coding subframes for analysis and coding:

$$d=|T-\beta P_{Lag}H-\alpha C_iH|^2$$

where T is the target signal that represents the perceptually filtered input signal, and H is the impulse response matrix of the filter W(z)/A(z). $P_{Lag}$ is the pitch prediction contribution having pitch Lag "Lag" and prediction coefficient, or gain, "β" which is uniquely defined for a given lag, and $C_i$ is the codebook contribution associated with index "i" in the codebook and its corresponding gain "α." In addition, "i" takes values between 0 and $N_{c-l}$, where $N_c$ is the size of the excitation codebook.

Thus, given a particular pitch lag Lag and gain β, a pitch prediction contribution can be removed from the LPC residual r(n). The resulting signal $$\epsilon(n)=r(n)+\delta(n)$$

is called the pitch residual. The coding of this signal determines the excitation signal. In a CELP codec, the pitch residual is vector quantized by selecting an optimum codebook entry (quantizer) that best matches:

$$\epsilon(n)=\alpha c_i(n)+\delta(n)$$

where $c_i(n)$ is the $n_{th}$ element of the $i_{th}$ quantizer, $\alpha$ is the associated gain, and $\delta(n)$ is the quantization error signal.

The codebook may be populated randomly or trained by selecting codebook entries frequently used in coding training data. A randomly populated codebook, for example, requires no training, or knowledge of the quantization error vectors from the previous stage. Such random codebooks also provide good quality estimation, with little or no signal dependency. A random codebook is typically populated using a Gaussian distribution, with little or no bias or assumptions of input or output coding. Nevertheless, random codebooks require substantial complexity and a significant amount of memory. In addition, random code-vectors do not accommodate the pitch harmonic phenomena, particularly where a long subframe is used.

One challenge in employing a random codebook is that a substantial amount of training is necessary to ensure "good" quality speech coding. For example, with a trained codebook, the code-vector distribution within the codebook is arranged to represent speech signal vectors. Conversely, a randomly populated codebook inherently has no such intelligent vector distribution. Thus, if the vectors happen to be distributed in an ineffective manner for encoding a given speech signal, undesirable large coding errors may result.

In a trained codebook, particular input vectors that represent the coded vector are selected. The vector having the shortest distance to other vectors within the grouping may be selected as an input vector. Upon partitioning the vector space into particular input vectors that represent each subspace, the coordinates of the representative vectors are input into the codebook. Although training avoids a codebook having disjoint and poorly organized vectors, there may be instances when the input vectors should represent very high or very low frequency speech (e.g., common female or male speech). In such cases, input vectors at opposite ends of the vector space may be desirable.

Another drawback to a trained codebook is that since the codebook is signal dependent, to develop a multi-lingual speech coder, training must accommodate a variety of different languages. Such codebook training would be intrinsically complex. In either case, whether using a conventional trained or untrained codebook, the memory storage requirements are significant. For example, in a typical 10–12 bit codebook that requires 30–40 samples, approximately 40,000 bits are necessary to store the codebook.

SUMMARY OF THE INVENTION

Various aspects of the present invention can be found in a codebook structure used in modeling and communicating speech. The codebook structure comprises an analog-to-digital (A/D) converter, speech processing circuitry for processing a digital signal received from the A/D converter, channel processing circuitry for processing the digital signal, speech memory, channel memory, additional speech processing circuitry and channel processing circuitry for further processing of the digital signal and a digital-to-analog converter (D/A). The speech memory comprises a fixed codebook and an adaptive codebook.

The speech processing circuitry comprises an adaptive codebook that receives a reconstructed speech signal, a gain that is multiplied by the output of the adaptive codebook, a fixed codebook that also receives the reconstructed speech signal, a gain that is multiplied by the output of the fixed codebook, a software control formula to sum the signals from the adaptive and fixed codebooks in order to generate an excitation signal and a synthesis filter that generates a new reconstructed speech signal from the excitation signal.

The fixed codebooks are comprised of two or more sub-codebooks. Each of the sub-codebooks is populated in such a way that the corresponding code-vectors of each of the corresponding sub-codebooks are set to an energy level of one, that is, are orthogonal to each other.

Zeroes can be inserted into the code-vectors, one or more at a time, either in the sub-codebook entries directly or immediately prior to combining corresponding code-vectors to form an excitation vector.

The bits of the combination code-vectors are generally intertwined, but can also be combined sequentially, that is, retaining the bit order found in each of the original code-vectors prior to combination.

DETAILED DESCRIPTION OF THE PREFERRED EMBODIMENTS

Figure 1:
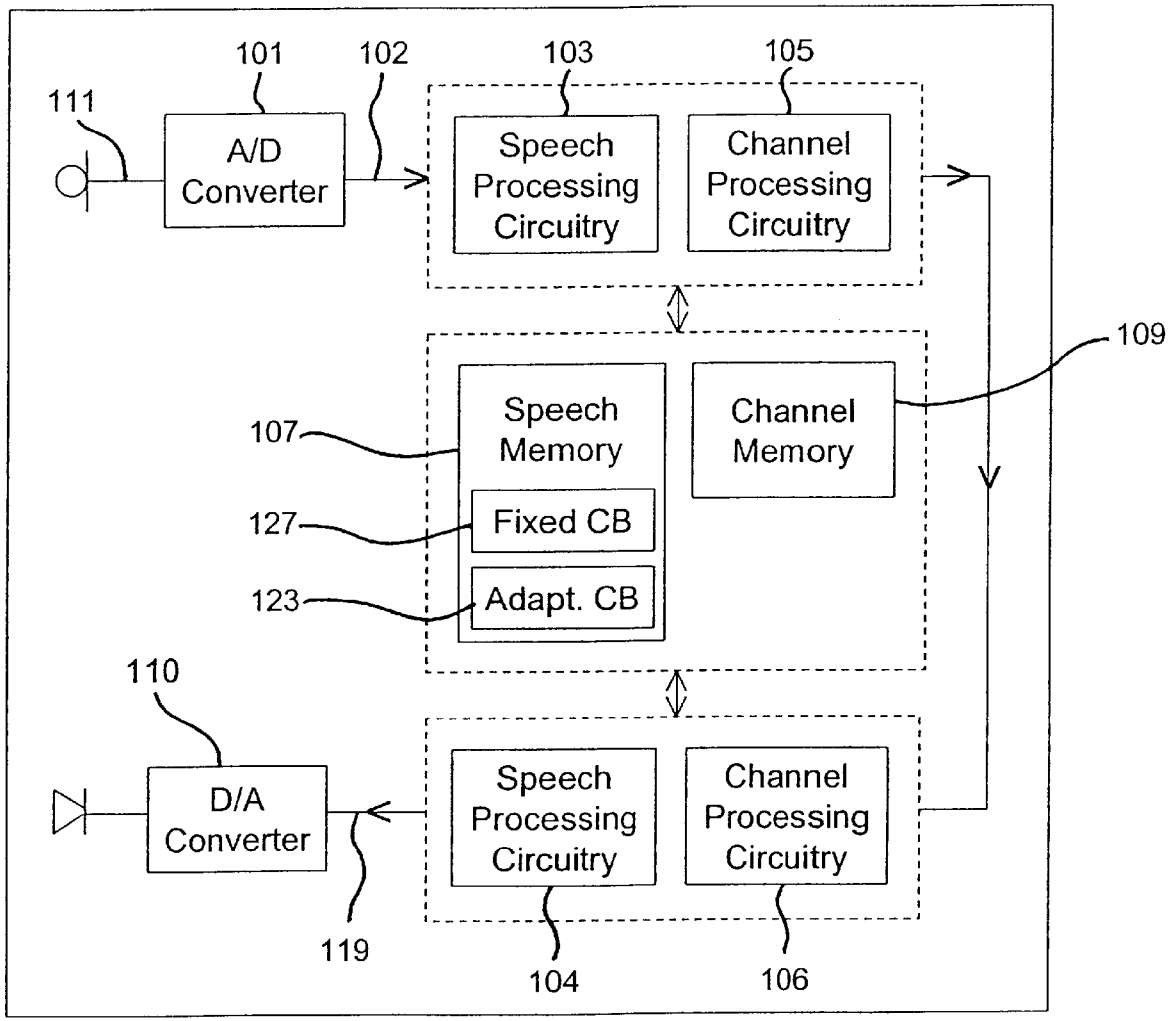
FIG. 1 is a schematic block diagram of a voice communication system illustrating the use of source encoding and decoding in accordance with the present invention.

The block diagram of the general codebook structure is shown in FIG. 1. An analog speech input signal 111 is processed through an analog-to-digital (AID) signal converter 101 to create a digital signal 102. The digital signal is then routed through speech encoding processing circuitry 103 and channel encoding processing circuitry 105. The digital signal 102 may be destined for another communication device (not shown) at a remote location.

As speech is received, a decoding system performs channel and speech decoding with the digital-to-analog (D/A) signal converter 110 and a speaker to reproduce something that sounds like the originally captured speech input signal 111.

The encoding system comprises both a speech processing circuit 103 that performs speech encoding, and a channel processing circuit 105 that performs channel encoding. Similarly, the decoding system comprises a speech processing circuit 104 that performs speech decoding, and a channel processing circuit 106 that performs channel decoding.

Although the speech processing circuit 103 and the channel processing circuit 105 are separately illustrated, they might be combined in part or in total into a single unit. For example, the speech processing circuit 103 and the channel processing circuit 105 might share a single DSP (digital signal processor) and/or other processing circuitry. Similarly, the speech processing circuit 104 and the channel processing circuit 106 might be entirely separate or combined in part or in whole. Moreover, combinations in whole or in part might be applied to the speech processing circuits 103 and 104, the channel processing circuits 105 and 106, the processing circuits 103, 104, 105, and 106, or otherwise.

The encoding and decoding systems both utilize a memory. The speech processing circuit 103 utilizes a fixed codebook 127 and an adaptive codebook 123 of a speech memory 107 in the source encoding process. The channel processing circuit 105 utilizes a channel memory 109 to perform channel encoding. Similarly, the speech processing circuit 104 utilizes the fixed codebook 127 and the adaptive codebook 123 in the source decoding process. The channel processing circuit 105 utilizes the channel memory 109 to perform channel decoding.

Although the speech memory 107 is shared as illustrated, separate copies thereof can be assigned for the processing circuits 103 and 104. The memory also contains software utilized by the processing circuits 103, 104, 105, and 106 to perform various functionality required in the source and channel encoding and decoding process.

Figure 2:
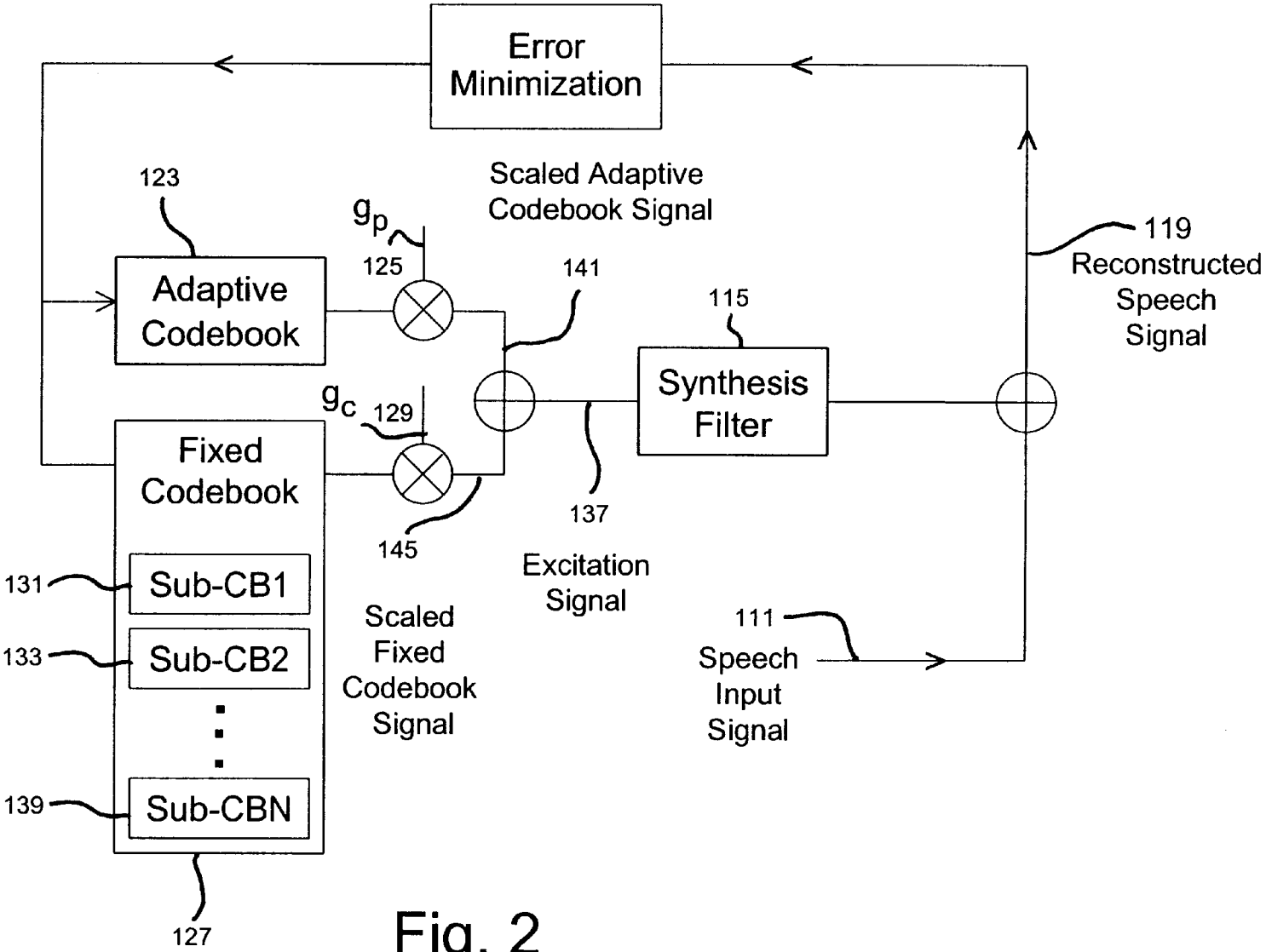
FIG. 2 is a block diagram of a speech encoder built in accordance with the present invention.

FIG. 2 shows a block diagram of the speech encoder of the present invention. An excitation signal 137 is given by the sum of a scaled adaptive codebook signal 141 and a scaled fixed codebook signal 145. The excitation signal 137 is used to drive a synthesis filter 115 that models the effects of speech. The excitation signal 137 is passed through the synthesis filter 115 to produce a reconstructed speech signal 119.

Parameters for the adaptive codebook 123 and the fixed codebook 127 are chosen to minimize the weighted error between the reconstructed speech signal 119 and an input speech signal 111. In effect, each possible codebook entry is passed through the synthesis filter 115 to test which entry gives an output closest to the speech input signal 111.

The error minimization process involves first stepping the reconstructive speech signal 119 through the adaptive codebook 123 and multiplying it by a gain "$g_p$" 125 to generate the scaled adaptive codebook signal 141. The reconstructed speech signal 119 is then stepped through the fixed codebook 127 and multiplied by a gain "$g_p$" 129 to generate the scaled fixed codebook signal 145, which is then summed with the scaled adaptive codebook signal 141 to generate the excitation signal 137.

The first and second error minimization steps can be performed simultaneously, but are typically performed sequentially due to the significantly greater mathematical complexity arising from simultaneous application of the reconstructed speech signal 119 to the adaptive codebook 123 and the fixed codebook 127.

The fixed codebook 127 contains a plurality of sub-codebooks, for example, "sub-CB1" 131, "Sub-CB2" 133 to "Sub-CBN" 139.

To minimize the coding error, particular input vectors are selected to represent a coded vector 131, for example. These particular input vectors indicate the shortest distance within any input speech sample or cluster of samples. Consequently, a speech vector space can be represented by plural input vectors for each subspace. The coordinates of the representative vectors are then input into the codebook. Once the codebook has been determined, it is considered to be fixed, that is, the fixed codebook 127. The representative code-vectors thus should not vary according to each sub-frame analysis.

Figure 3:
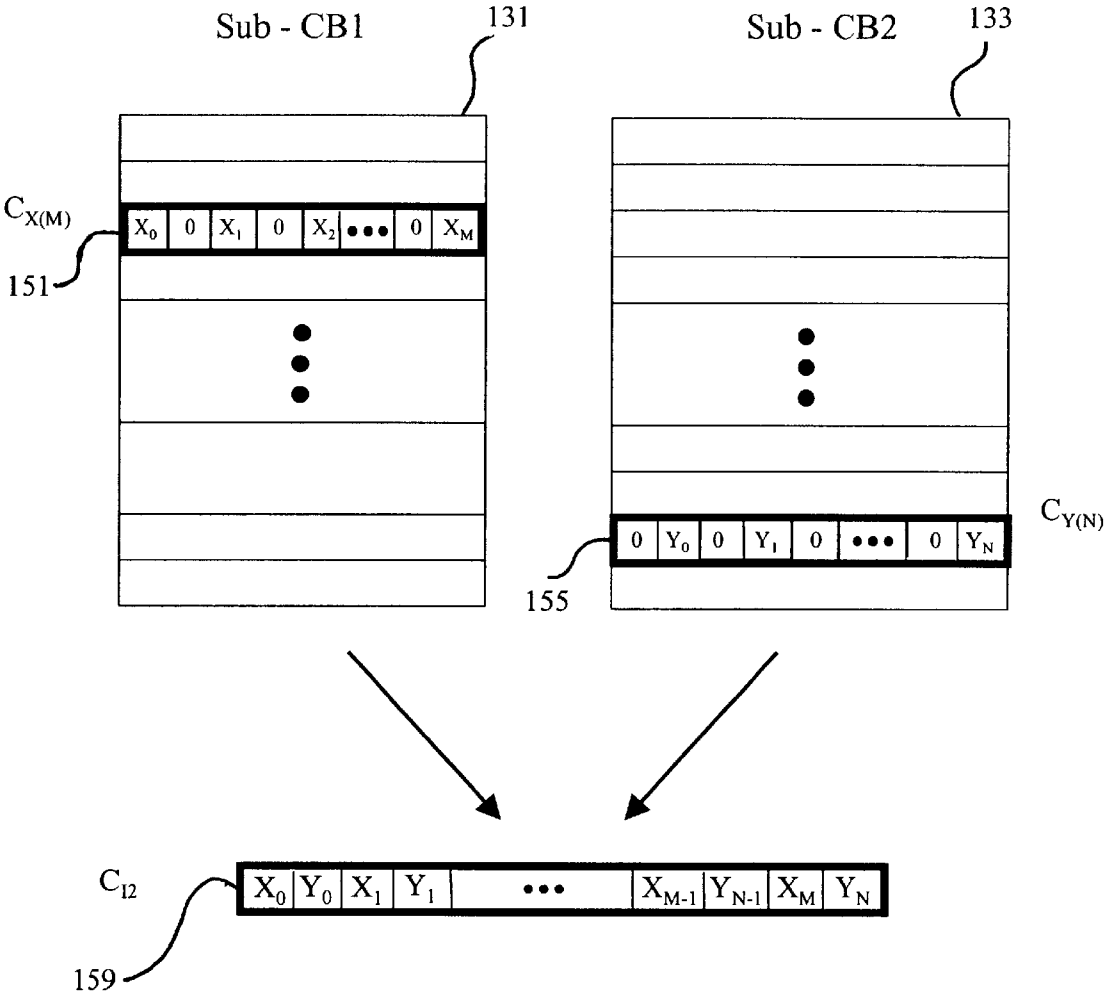
FIG. 3 is a block diagram of sub-codebooks arranged in accordance with the present invention.
Figure 4:
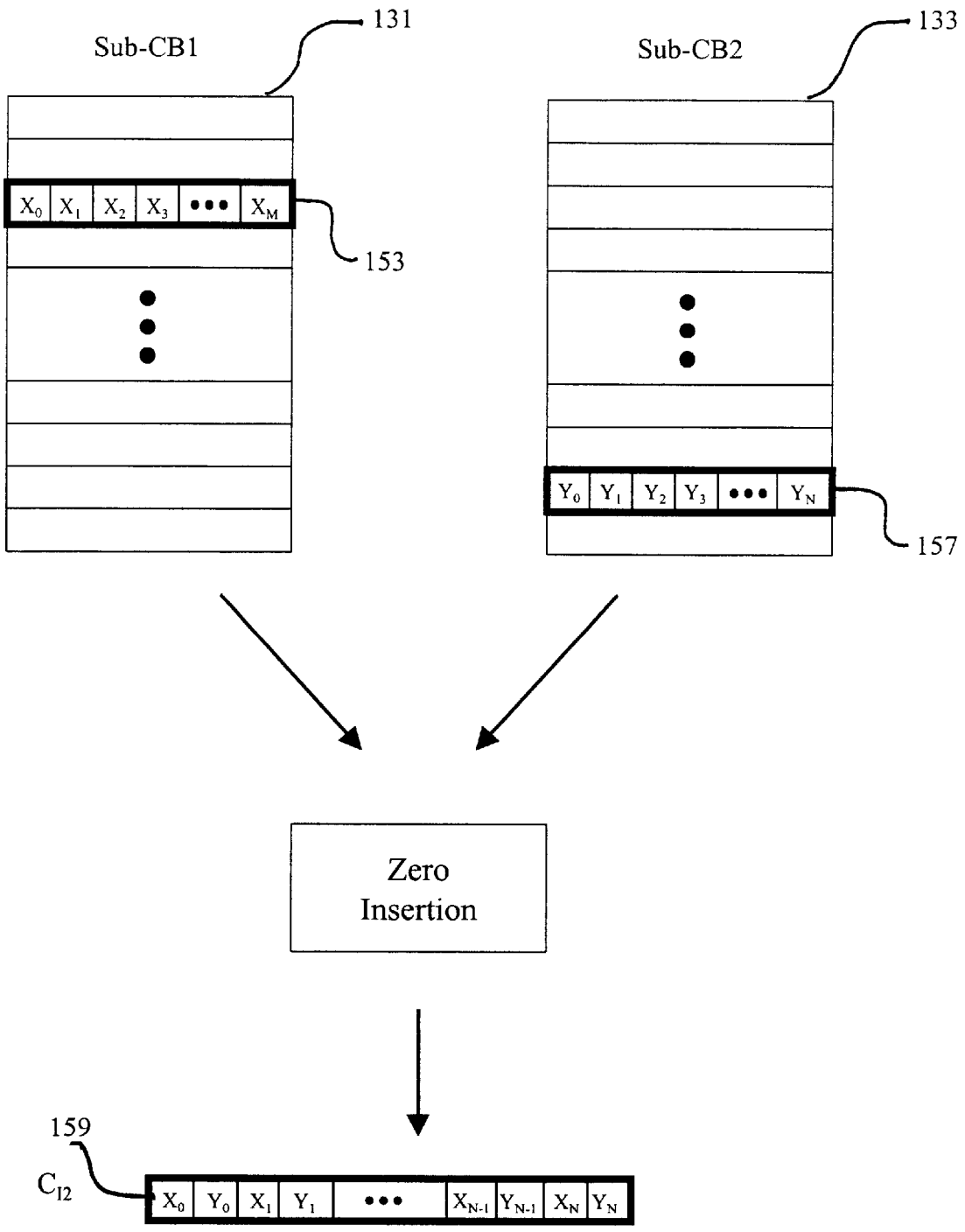
FIG. 4 is a block diagram of sub-codebooks that illustrates the availability of zero insertion into the code-vectors in accordance with the present invention.

The fixed codebook 127 is represented by two or more sub-codebooks that are individually stored in the memory of a computer or other communication device in which the speech coding is performed. Because typical 10–12 bit codebooks require a large amount of storage space, codebook embodiments of the present invention utilize a split codebook approach in which the primary fixed codebook is represented and, therefore, stored as a plurality of sub-codebooks Sub-CB1 131 and Sub-CB2 133, as shown in FIGS. 2 and 3. The sub-codebooks are combined into a single codebook using a matrix transformation. Consequently, the single codebook can be effectively searched for an acceptably representative excitation vector, while requiring substantially less storage and search complexity. FIG. 3 shows sub-codebooks Sub-CB1 131 and Sub-CB2 133 in which a subvector $C_x(m)$ 151, of sub-codebook Sub-CB1 131 of width M bits, consisting of bits $X_0, X_1, X_2 \ldots, X_M$, with or without inserted zeroes, is combined with a subvector $C_{y(N)}$ 155, of width N bits, consisting of bits $Y_0, Y_1, Y_2, \ldots, Y_N$, with or without inserted zeroes, to form excitation vector $C_{12}$, 159, consisting of bits $X_0, Y_0, X_1, Y_1, \ldots, X_{M-1}, Y_{N-1}, X_M, Y_N$. FIG. 4 shows that the zeroes may be inserted immediately prior to combination of the subvectors $C_X$ 153 and $C_Y$ 157 to form the excitation vector $C_{12}$ 159, or can be inserted directly into the subvectors $C_X$ 151 and $C_Y$ 155 in the sub-codebooks, as indicated in FIG. 3.

Figure 5:
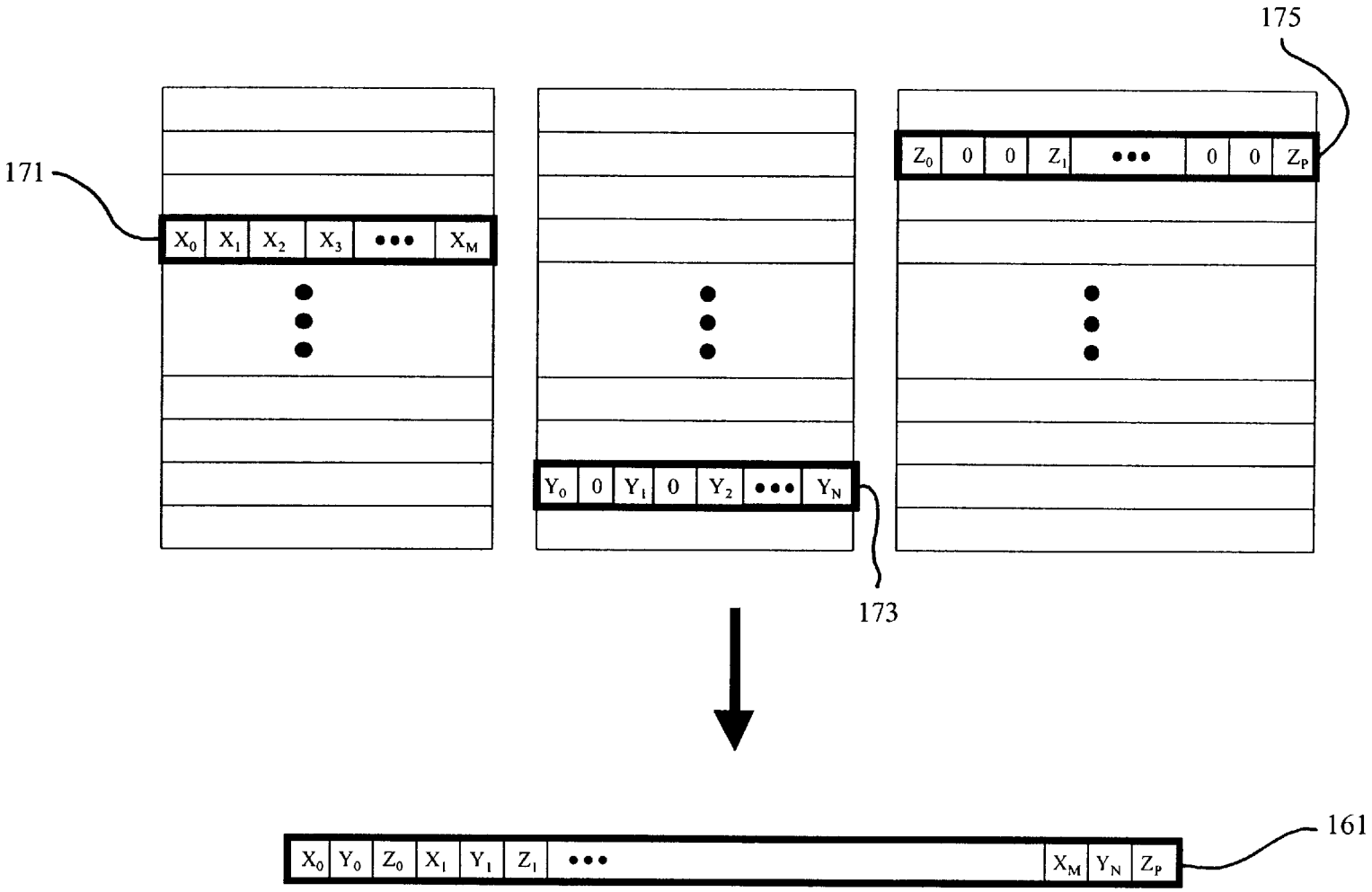
FIG. 5 is a block diagram of a plurality of sub-codebooks arranged in accordance with the present invention.

Finally, FIG. 5 demonstrates that more than two sub-codebooks, that is, a plurality of sub-codebooks,e can be combined into a single codebook and, thus, more than two subvectors can be combined to form an excitation vector $C_{13+}$161. Additionally, FIG. 5 shows that the zeroes can be inserted into subvectors 171, 173 and 175 one at a time, two or more at a time or not at all.

According to the present invention, the two sub-codebooks Sub-CB1 131 and Sub-CB2 are combined by adding their corresponding code-vectors together. If desired, an element of the code-vectors is a sign bit that is used to control the manner of adding the corresponding code-vectors together. As indicated in FIG. 3, the subvector $C_{x(M)}$ 151 and $C_{Y(N)}$ 155 forming the individual codebooks are determined such that $C_{x(M)}$ and $C_{Y(N)}$ have corresponding orthogonal vectors, in which every other bit in both subvectors 151 and 155 is set to zero, while the remaining samples are populated randomly. When the individual vector components of corresponding excitation vectors are added to produce the codebook $C_{12}$ 159, the energy $Z^2$ of the codebook is $$E=Z^2=x^2+y^2+2xy.$$

However, because of the orthogonal nature of the two or more sub-codebooks when combined, the "xy," or cross, term is zero, and the energy term reduces to:

$$Z^2=x^2+y^2$$

Each codebook contains N excitation vectors of length L. The selection of the excitation vector that best represents the original speech is performed by a codebook search procedure. Generally, the codebooks are searched using a weighted mean square error (MSE) criterion. Each excitation vector $C_i$ is scaled by a gain vector, and is then passed through a synthesis filter $1/A(z/\gamma)$to produce $C_iH^T$, where H(z) represents the code-vector weighted synthesis filter.

The individual codebook matrices are stored separately in the system speech memory. The codebooks can later be combined by adding together the code-vectors to form a single codebook that would otherwise require an exponentially larger amount of memory. The combined form of the codebook would generally be represented by code-vectors:

$$c=\epsilon_i X_i+\epsilon_j X_j$$

where the x and y codebooks are naturally orthogonal in accordance with the present invention. As indicated in FIG. 3, when the two individual codebooks are combined, every sample is non-zero. For example, since only the odd samples are non-zero in the x vector and, in the y vector only the even samples are non-zero, the resultant matrix contains only non-zero samples. That is, the orthogonal matrix values are an interwoven arrangement of the x vector samples and the y vector samples.

Thus, by utilizing the described fixed codebook configuration having at least two sub-codebooks, less complexity, and consequently, less computing resources, are required. The combined excitation scheme provides better predictive gain quantization, while also reducing complexity and system response time by using a constrained codebook searching procedure.

This detailed description is set forth only for purposes of illustrating examples of the present invention and should not be considered to limit the scope thereof in any way. Clearly, numerous additions, substitutions, and other modifications can be made to the invention without departing from the scope of the invention that is defined in the appended claims and equivalents thereof.

What is claimed is:

1. A codebook structure for providing an excitation vector for speech coding, the codebook structure comprising:

a first fixed codebook having at least one first fixed subvector;

a second fixed codebook associated with the first fixed codebook, the second fixed codebook having at least one second fixed subvector; and an excitation vector formed by combining the at least one first fixed subvector and the at least one second fixed subvector, where a position of interwoven zero value elements of the second fixed subvector correspond to non-zero value elements of the first fixed subvector and non-zero value elements of the second fixed subvector correspond to interwoven zero value elements of the first fixed subvector;

wherein the interwoven zero value elements are not stored with the at least one first fixed subvector and the at least one second fixed subvector.

2. The codebook structure of claim 1 further including an encoder processing circuit.

3. The codebook structure of claim 2 where the encoder processing circuit inserts zero value elements in between non-zero value elements of the at least one first fixed subvector to form a modified first subvector.

4. The codebook structure of claim 3 where the encoder processing circuit inserts zero value elements in between non-zero value elements of the of the at least one second fixed subvector to form a modified second subvector.

5. The codebook structure of claim 4 where the modified first subvector includes odd zero value elements; and the modified second subvector includes even zero value elements.

6. The codebook structure of claim 4 further comprising at least one additional fixed codebook associated with the first fixed codebook and the second fixed codebook, the at least one additional codebook including at least one additional subvector; and an encoder processing circuit that combines the first fixed subvector, the second fixed subvector and the at least one additional fixed subvector to form the excitation vector.

7. The codebook structure of claim 6 where a position of zero value elements of the first fixed subvector correspond to non-zero value elements of the second fixed subvector and the at least one additional fixed subvector, zero value elements of the second fixed subvector correspond to non-zero value elements of the first fixed subvector and the at least one additional fixed subvector, and zero value elements of the at least one additional fixed subvector correspond to non-zero value elements of the second fixed subvector and the first fixed subvector.

8. The codebook structure of claim 1 further including a synthesis filter.

9. The codebook structure of claim 8 where the excitation vector is formed without having first been passed through the synthesis filter.

10. A codebook structure for providing an excitation vector for speech coding, the codebook structure comprising:

a first fixed codebook having at least one first fixed subvector;

a second fixed codebook associated with the first fixed codebook, the second fixed codebook having at least one second fixed subvector;

a third fixed codebook associated with the first fixed codebook and the second fixed codebook, the third fixed codebook having at least one third fixed subvector; and an excitation vector formed by combining the at least one first fixed subvector, the at least one second fixed subvector and the at least one third fixed subvector prior to filtering the excitation vector, where prior to forming the excitation vector a position of zero value elements of the first fixed subvector correspond to non-zero value elements of the second fixed subvector and the third fixed subvector, zero value elements of the second fixed subvector correspond to non-zero value elements of the first fixed subvector and the third fixed subvector, and zero value elements of the third fixed subvector correspond to non-zero value elements of the second fixed subvector and the first fixed subvector.

11. The codebook structure of claim 10 further including an encoder processing circuit.

12. The codebook structure of claim 11 where the encoder processing circuit inserts zero value elements in between non-zero value elements of the at least one first fixed subvector to form a modified first subvector.

13. The codebook structure of claim 11 where the encoder processing circuit inserts zero value elements in between non-zero value elements of the of the at least one first fixed subvector the at least one second fixed subvector to form a modified first subvector and a modified second subvector.

14. The codebook structure of claim 11 where the encoder processing circuit inserts zero value elements in between non-zero value elements of the of the at least one first fixed subvector the at least one second fixed subvector and the at least one third fixed subvector to form a modified first subvector, a modified second subvector and a modified third subvector.

15. The codebook structure of claim 10 further including a synthesis filter.

16. The codebook structure of claim 15 where the excitation vector is formed without having first been passed through the synthesis filter.

* * * * *